US008157599B2

(12) United States Patent
Wei

(10) Patent No.: US 8,157,599 B2
(45) Date of Patent: Apr. 17, 2012

(54) ELECTRICAL CONNECTOR

(75) Inventor: Ke Chang Wei, Shanghai (CN)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/243,291

(22) Filed: Sep. 23, 2011

(65) Prior Publication Data

US 2012/0015560 A1 Jan. 19, 2012

Related U.S. Application Data

(63) Continuation of application No. 12/691,820, filed on Jan. 22, 2010, now Pat. No. 8,038,480.

(30) Foreign Application Priority Data

Jan. 22, 2009 (CN) ..... 2009 2 0001857 U

(51) Int. Cl.
*H01R 24/00* (2011.01)

(52) U.S. Cl. ..... 439/660; 439/607.01

(58) Field of Classification Search ..... 439/660, 439/607.01, 607.35, 607.36, 607.4
See application file for complete search history.

(56) References Cited

U.S. PATENT DOCUMENTS

| | | | | |
|---|---|---|---|---|
| 6,099,327 | A * | 8/2000 | Chen | 439/95 |
| 6,619,968 | B2 * | 9/2003 | Xu | 439/79 |
| 6,672,905 | B2 * | 1/2004 | Tharp et al. | 439/660 |
| 7,517,253 | B1 * | 4/2009 | Chiang | 439/660 |
| 7,578,705 | B2 * | 8/2009 | He et al. | 439/660 |
| 7,625,243 | B2 * | 12/2009 | Chen et al. | 439/660 |
| 7,632,145 | B1 * | 12/2009 | Lin et al. | 439/607.32 |
| 7,744,426 | B2 * | 6/2010 | Zheng et al. | 439/660 |
| 7,748,997 | B2 * | 7/2010 | Hamner et al. | 439/79 |
| 7,748,999 | B1 * | 7/2010 | Sun et al. | 439/79 |
| 7,762,840 | B2 * | 7/2010 | Hamner et al. | 439/541.5 |
| 7,811,131 | B2 * | 10/2010 | Wang et al. | 439/607.35 |
| 7,833,065 | B2 * | 11/2010 | Lin et al. | 439/639 |
| 7,841,910 | B2 * | 11/2010 | Fields et al. | 439/680 |
| 7,845,982 | B1 * | 12/2010 | Wang | 439/607.25 |
| 7,883,372 | B1 * | 2/2011 | Sun et al. | 439/607.55 |
| 8,007,323 | B1 * | 8/2011 | Yao et al. | 439/660 |
| 8,011,969 | B2 * | 9/2011 | Wang et al. | 439/660 |
| 8,021,188 | B1 * | 9/2011 | Ma et al. | 439/607.55 |
| 8,025,532 | B2 * | 9/2011 | Nagata et al. | 439/607.4 |
| 8,033,868 | B2 * | 10/2011 | Wang et al. | 439/660 |
| 8,038,480 | B2 * | 10/2011 | Wei | 439/660 |
| 8,052,471 | B1 * | 11/2011 | Xiong et al. | 439/607.01 |
| 2005/0272286 | A1 * | 12/2005 | Lapidot et al. | 439/108 |
| 2008/0311801 | A1 * | 12/2008 | Chen et al. | 439/733.1 |
| 2009/0042448 | A1 * | 2/2009 | He et al. | 439/650 |

(Continued)

FOREIGN PATENT DOCUMENTS

CN 201130777 Y 8/2008

*Primary Examiner* — Ross Gushi
(74) *Attorney, Agent, or Firm* — Stephen L. Sheldon

(57) ABSTRACT

An electrical connector includes an insulating housing with a tongue plate protruding forwards from a front portion thereof and a plurality of conductive terminals comprising an upper row of conductive terminals and a lower row of conductive terminals which are mounted on upper and lower sides of the tongue plate respectively. The terminals include a butting portion, a soldering portion, and a bending portion connected between the butting portion and the soldering portion. At least one positioning modules is mounted into the accommodating chamber of the insulating housing so that it envelopes a periphery of the bending portions of the plurality of conductive terminals.

12 Claims, 10 Drawing Sheets

U.S. PATENT DOCUMENTS

2009/0111330 A1* 4/2009 Lin et al. ..... 439/638
2009/0117754 A1* 5/2009 Fields et al. ..... 439/55
2009/0130870 A1* 5/2009 Wu et al. ..... 439/83
2009/0130873 A1* 5/2009 He ..... 439/108
2009/0156027 A1* 6/2009 Chen ..... 439/83
2010/0015855 A1* 1/2010 Chiang ..... 439/660
2010/0022135 A1* 1/2010 Hamner et al. ..... 439/630
2010/0055986 A1* 3/2010 Wang et al. ..... 439/638
2010/0093208 A1* 4/2010 Hamner et al. ..... 439/541.5
2010/0167583 A1* 7/2010 Lin et al. ..... 439/607.01
2010/0167594 A1* 7/2010 Lee et al. ..... 439/660
2010/0210139 A1* 8/2010 Wei ..... 439/607.01
2010/0267282 A1* 10/2010 Tsai ..... 439/607.17

* cited by examiner

ELECTRICAL CONNECTOR

This application is a continuation of U.S. application Ser. No. 12/691,820, filed Jan. 22, 2010, now U.S. Pat. No. 8,038,480, which in turns claims priority to Chinese Application No. 200920001857.X, filed Jan. 22, 2009, both of which are incorporated herein by reference in their entirety.

BACKGROUND OF THE INVENTION

1. Technical Field

The present invention relates to an electrical connector, in particular to an electrical connector which can prevent short circuit of conductive terminals due to contact with each other.

2. Background Art

As the electrical connector develops towards increasingly miniaturization, the conductive terminals in the electrical connector are designed to be more and more thin, and the spacing among the conductive terminals is more and more small, such that the conductive terminals are prone to contact with each other and the short circuit failure may occur when an external force is applied.

To efficiently prevent the short circuit between the conductive terminals due to contact with each other, Chinese Patent ZL 200720042398.0 disclosed an electrical connector, which generally comprises an insulating housing, a shielding housing and several conductive terminals assembled in the insulating housing, and a positioning plate. The positioning plate is provided with several positioning holes, which can fix the positions of soldering portions of these conductive terminals to prevent deflection thereof. However, this positioning plate with positioning holes can only cover the soldering portions of the conductive terminals which extend downwards vertically, and the bending portions extending between an butting portions and the soldering portions of the conductive terminals are still exposed at the outside of the positioning plate and can not be fixed in position. As a result, in case of assembly or application of an external force, the bending portions of the conductive terminals are still prone to contact with each other, and the short circuit may occur.

It can be seen that, there exists a need to improve the technique of preventing the short circuit between conductive terminals in the prior art electrical connector due to contact with each other.

SUMMARY OF THE INVENTION

An embodiment of the present invention includes an electrical connector with an insulating housing having an accommodating chamber at a rear portion thereof and a tongue plate protruding forwards from a front portion thereof. The connector includes a plurality of conductive terminals, comprising an upper row of conductive terminals and a lower row of conductive terminals mounted on upper and lower sides of the tongue plate respectively. In an embodiment, each conductive terminal can include a butting portion, a soldering portion, and a bending portion connected between the butting portion and the soldering portion. The butting portions of the upper row of conductive terminals and lower row of conductive terminals can be mounted on the upper and lower sides of the tongue plate respectively, and the soldering portions of each row of conductive terminals can extend from below the rear portion of the insulating housing and being arranged in a front column and a rear column. A shielding casing, covering periphery of the insulating housing can be provided. The electrical connector can further comprise at least one positioning module being mounted into the accommodating chamber of the insulating housing and enveloping periphery of the bending portions of said plurality of conductive terminals to prevent the conductive terminals from contacting with each other. In an embodiment, the positioning module can include a first positioning module enveloping periphery of the bending portions of the upper row of conductive terminals and a second positioning module enveloping periphery of the bending portions of the lower row of conductive terminals respectively, and the second positioning module is secured below the first positioning module.

DETAILED DESCRIPTION OF THE PREFERRED EMBODIMENTS

Figure 1:
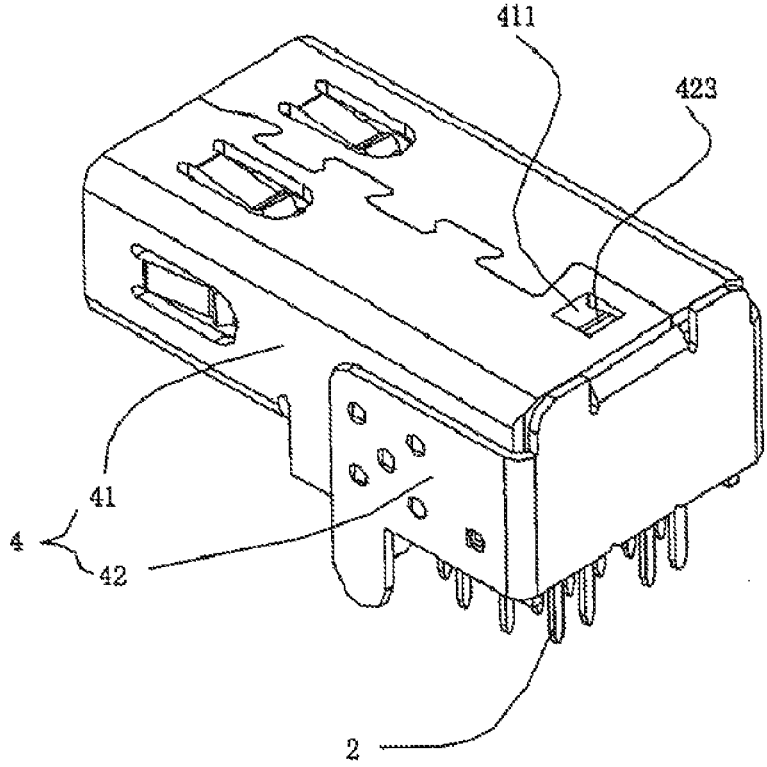
FIG. 1 is an assembled perspective view of an electrical connector according to a preferred embodiment of the present invention.

The present invention will be described in detail with reference to the drawings, by taking the Mini-Displayport electrical connector as an example. In comparison with the prior art, the beneficial technical effects of the present invention lie in that by providing at least one positioning modules enveloping the bending portions between the butting portions and soldering portions of the conductive terminals to define the position relationship among the conductive terminals, the bending portions of the conductive terminals can be prevented from further bending and contacting with each other when an external force is applied. Thus a short circuit failure can be prevented.

As shown in FIGS. 1 to 4, an electrical connector according to a preferred embodiment of the present invention comprises an insulating housing 1, a plurality of conductive terminals 2 fitted on the insulating housing 1, a positioning module 3 for fixing the plurality of conductive terminals 2, a spacer plate 34, and a shielding casing 4.

Figure 5:
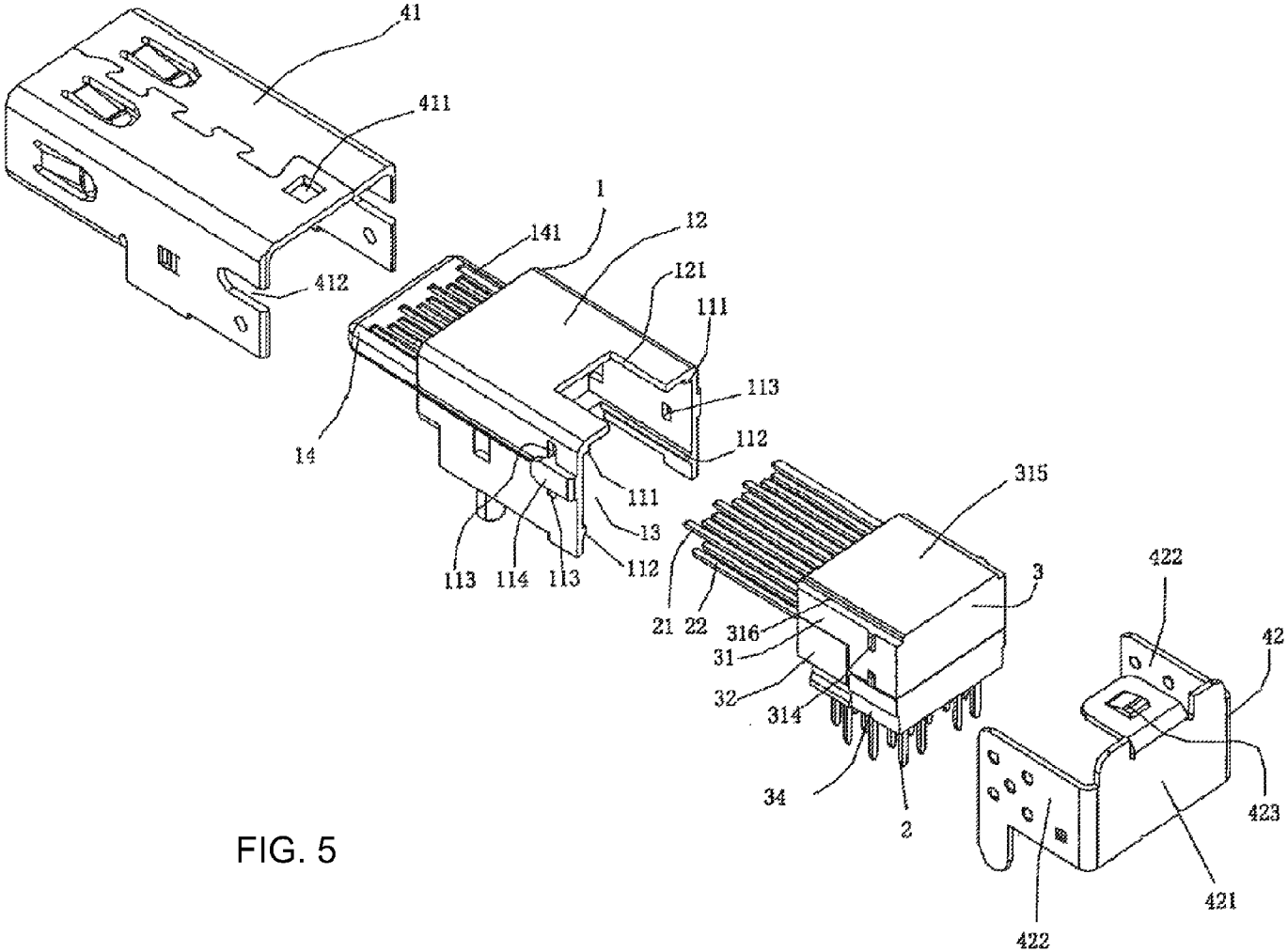
FIG. 5 is a further exploded perspective of an electrical connector according to a preferred embodiment of the present invention.
Figure 6:
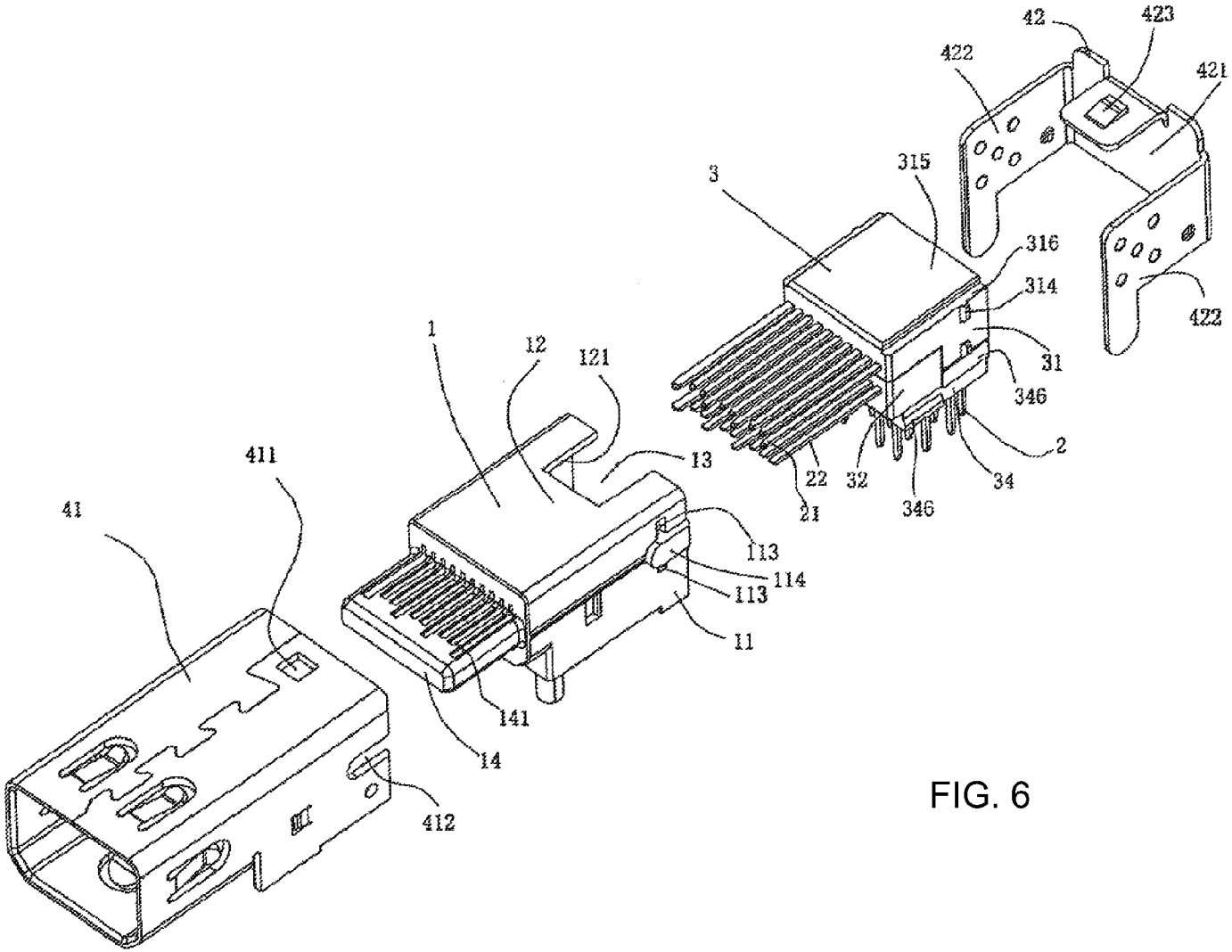
FIG. 6 is a further exploded perspective view of an electrical connector according to a preferred embodiment of the present invention shown in another angle of view.

Referring to FIGS. 5 and 6, an accommodating chamber 13 is provided at the rear portion of the insulating housing, which is formed by two sidewalls 11 and a top wall 12, and a tongue plate 14 is protruded forwards from the front portion of the insulating housing 1. A plurality of terminal receiving grooves 141 are provided at both of the upper and lower sides of the tongue plate 14, which penetrate through the insulating housing 1 from front to rear. Both of the inner surfaces of two sidewalls 11 of the insulating housing 1 at the rear portion protrude inwards to form an upper guide bar 111 and a lower guide bar 112 which extend along a longitudinal direction of the accommodating chamber 13, and both of the outer surfaces of the insulating housing 1 are provided with a positioning bump 114 which protrudes outwards. Each sidewall 11 of the insulating housing 1 is further provided with two positioning holes 113. These two positioning holes 113 are provided correspondingly at two sides of the positioning bump 114 on the outer surface of the sidewall 11 along the vertical direction. A recess 121 is recessed forwards from the rear edge of the top wall 12 of the insulating housing 1.

Referring to FIGS. 5 and 6, a plurality of conductive terminals 2 comprises two rows of conductive terminals which are mounted on the upper and lower sides of the tongue plate 14 of the insulating housing 1 respectively, i.e. an upper row of conductive terminals 21 and a lower row of conductive terminals 22. In the following, the structure and arrangement of the conductive terminals will be illustrated by taking the upper row of conductive terminals 21 as an example (also referring to FIGS. 11 to 14).

Figure 11:
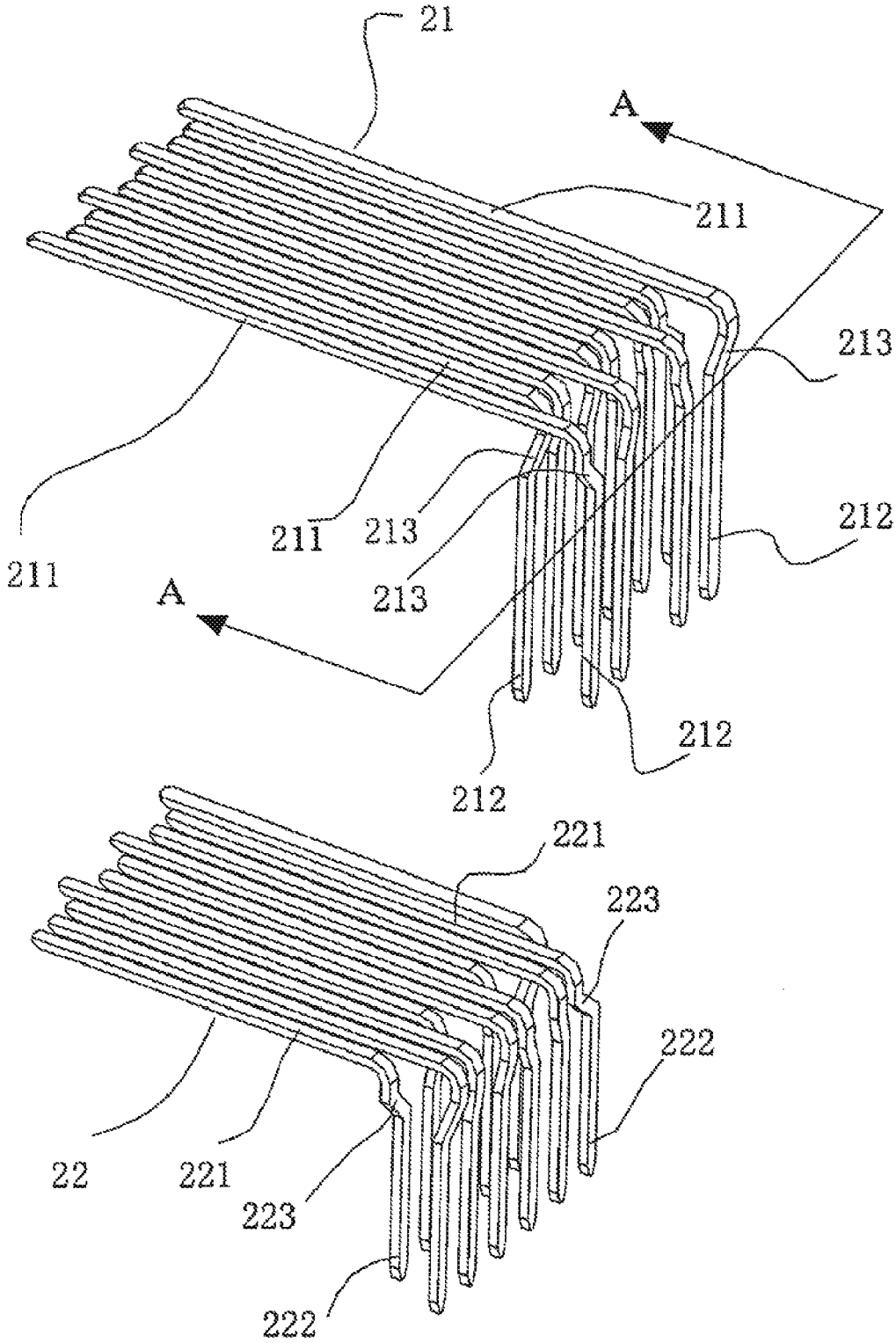
FIG. 11 is a perspective view of the upper and lower rows of conductive terminals in an electrical connector according to a preferred embodiment of the present invention.
Figure 12:
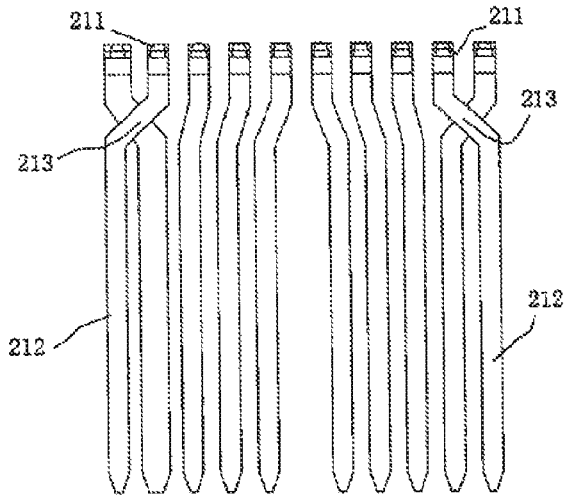
FIG. 12 is a view of the upper row of conductive terminals shown in FIG. 11 in a direction opposite to the butting direction.

The direction indicated by the arrow A-A in FIG. 11 is the plugging direction of the electrical connector. Each terminal in the upper row of conductive terminals 21 comprises a butting portion 211 extending straightly and horizontally along the butting direction of the electrical connector, a soldering portion 212 extending downwards vertically from the butting portion 211, and a bending portion 213 connected between the butting portion 211 and the soldering portion 212. The upper row of conductive terminals 21 comprises ten conductive terminals in total, among which the first, fourth, seventh, and tenth conductive terminals sorted sequentially from one side act as ground terminals, while the other six conductive terminals act as signal terminals for signal transmission. The butting portions 211 of the upper row of conductive terminals 21 are mounted into the receiving grooves 141 at the upper side of the tongue plate 14 of the insulating housing 1. The soldering portions 212 of the upper row of conductive terminals 21 are arranged into two columns in the accommodating chamber 13 of the insulating housing 1, wherein the soldering portions 212 of the conductive terminal 21 for grounding (i.e. ground terminals) are arranged in the rear column (as shown in FIG. 11), while the soldering portions 212 of the conductive terminal 21 for signal transmission (i.e. signal terminals) are arranged in the front column (as shown in FIG. 11). Arranging the soldering portions 212 of the upper row of conductive terminals 21 in this manner facilitates wiring in signal layers of a multi-layer circuit board (not shown in the figure) corresponding to the connector. Every two neighboring signal terminals constitute a pair of differential signal, and six signal terminals constitute three pairs of differential signal in total.

Figure 13:
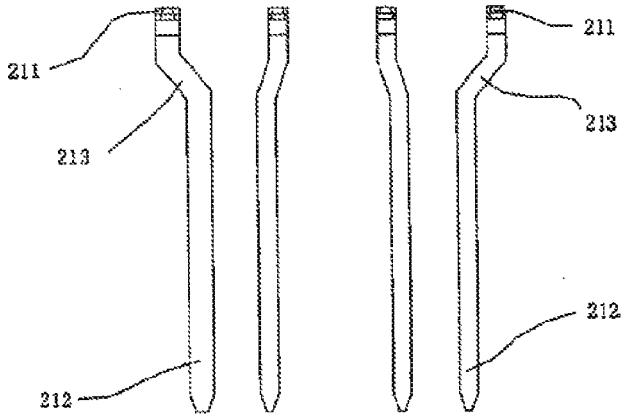
FIG. 13 is a view of conductive terminals whose soldering portions lie in the rear column among the upper row of conductive terminals shown in FIG. 11 in a direction opposite to the abutting direction.
Figure 14:
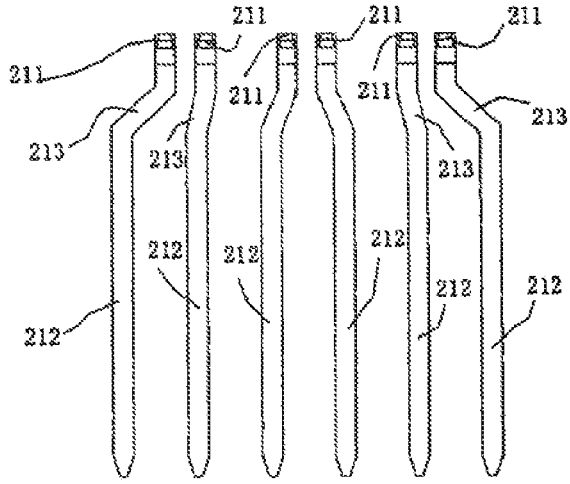
FIG. 14 is a view of conductive terminals whose soldering portions lie in the front column among the upper row of conductive terminals shown in FIG. 11 in a direction opposite to the abutting direction.

Referring to FIG. 14, the bending portions 213 of the upper row of conductive terminals 21 in the front column (i.e. signal terminals) are formed by bending rear ends of the butting portions 211 in a plane perpendicular to the butting direction laterally outwards (to the outer side of the left and right sides) and then downwards, so that the lateral spacing between the soldering portions 212 of two neighboring conductive terminals 21 which constitute a pair of differential signal is larger than that between the butting portions 211 thereof. This facilitates in reducing the possibility of soldering tin adhesion when the soldering portions 212 are soldered correspondingly to soldering holes of the circuit board (not shown in the figure), and preventing short circuit or cross-talk between two neighboring soldering portions 212. Referring to FIG. 13, the bending portions 213 of the upper row of conductive terminals 21 in the rear column (i.e. ground terminals) are formed by bending rear ends of the butting portions 211 in a plane perpendicular to the butting direction in such a way that each pair of two neighboring conductive terminals are bent toward each other and then bent downwards. As a result, the lateral spacing between the soldering portions 212 of two neighboring conductive terminals 21 acting as a pair of ground terminals is smaller than that of the butting portions 211 thereof.

Similarly, each terminal in the lower row of conductive terminals 22 also comprises a butting portion 221 extending along the butting direction, a soldering portion 222 extending downwards vertically, and a bending portion 223 connected between the butting portion 221 and the soldering portion 222. The butting portion 221 of the lower row of conductive terminals 22 are mounted into the receiving grooves 141 at the lower side of the tongue plate 14 of the insulating housing 1. The bending portions of the front and rear columns of the lower row of conductive terminals 22 bend in the lateral direction in a manner substantially identical with that of the bending portions of the front and rear columns of the upper row of conductive terminals 21. The soldering portions 222 of the lower row of conductive terminals 22 are also arranged into a front column and a rear column, but differ from those of the upper row of conductive terminals 21 in that the soldering portions 222 of the conductive terminals 22 for grounding or connecting with the power supply are arranged in the front column, while the soldering portions 222 of the conductive terminals 22 for signal transmission (i.e. signal terminals) 22 are arranged in the rear column.

The positioning module 3 is mounted into the accommodating chamber 13 of the insulating housing 1 and envelope the periphery of the bending portions 213, 223 of the plurality of conductive terminals 2, in order to prevent the conductive terminals 2 from contacting with each other when an external force is applied, thusly prevent short circuit failure. Also referring to FIGS. 5 to 10, the positioning module 3 comprises a first positioning module 31, a second positioning module 32, and an adhesive sheet 33 provided on the second positioning module 32 which adheres the first positioning module 31 with the second positioning module 32.

Referring to FIGS. 8 to 11, the first positioning module 31 is formed at the periphery of the bending portions 213 of the upper row of conductive terminals 21 by insert molding process, and is of a step body in "□" shape which is small in the front and large in the rear. The bottom portion of the first positioning module 31 includes a first bottom surface 311, a second bottom surface 312 lower than the first bottom surface 311, and a vertical wall surface 313 connected between the first bottom surface 311 and the second bottom surface 312. Two side surfaces of the first positioning module 31 are provided respectively with two protruding portions 314 which protrude outwards, so as to fasten with the corresponding two positioning holes 113 in the sidewall 11 of the insulating housing 1. Both side edges of the top surface 315 of the first positioning module 31 are recessed to form guide grooves 316 extending in the longitudinal direction. The guide grooves 316 slidably fit with the upper guide bars 111 on the inner surface of the sidewall 11 at the rear portion of the insulating housing 1, so as to facilitate guiding and fitting the first positioning module 31 to the insulating housing 1.

Referring to FIGS. 8 to 11, the second positioning module 32 is provided below the bottom portion of the first positioning module 31. The second positioning module 32 is also formed at the periphery of the bending portions 223 of the lower row of conductive terminals 22 by insert molding process, and is substantially in a shape of rectangular parallelepiped. The second positioning module 32 includes a top surface 321, a bottom surface 322, and a rear end surface 324. The center of the top surface 321 is provided with a recessed portion 323 to accommodate the adhesive sheet 33, so that the second positioning module 32 adheres with the first bottom surface 311 of the first positioning module 31 via the adhesive sheet 33.

Figure 8:
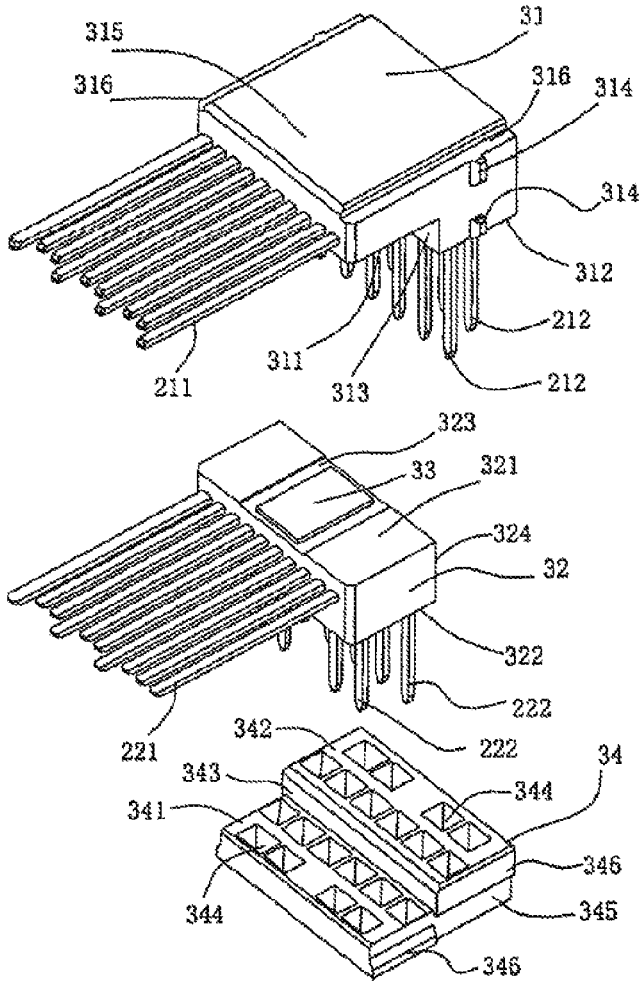
FIG. 8 is an exploded perspective view of conductive terminals, a positioning module, and a spacer plate in an electrical connector according to a preferred embodiment of the present invention.
Figure 9:
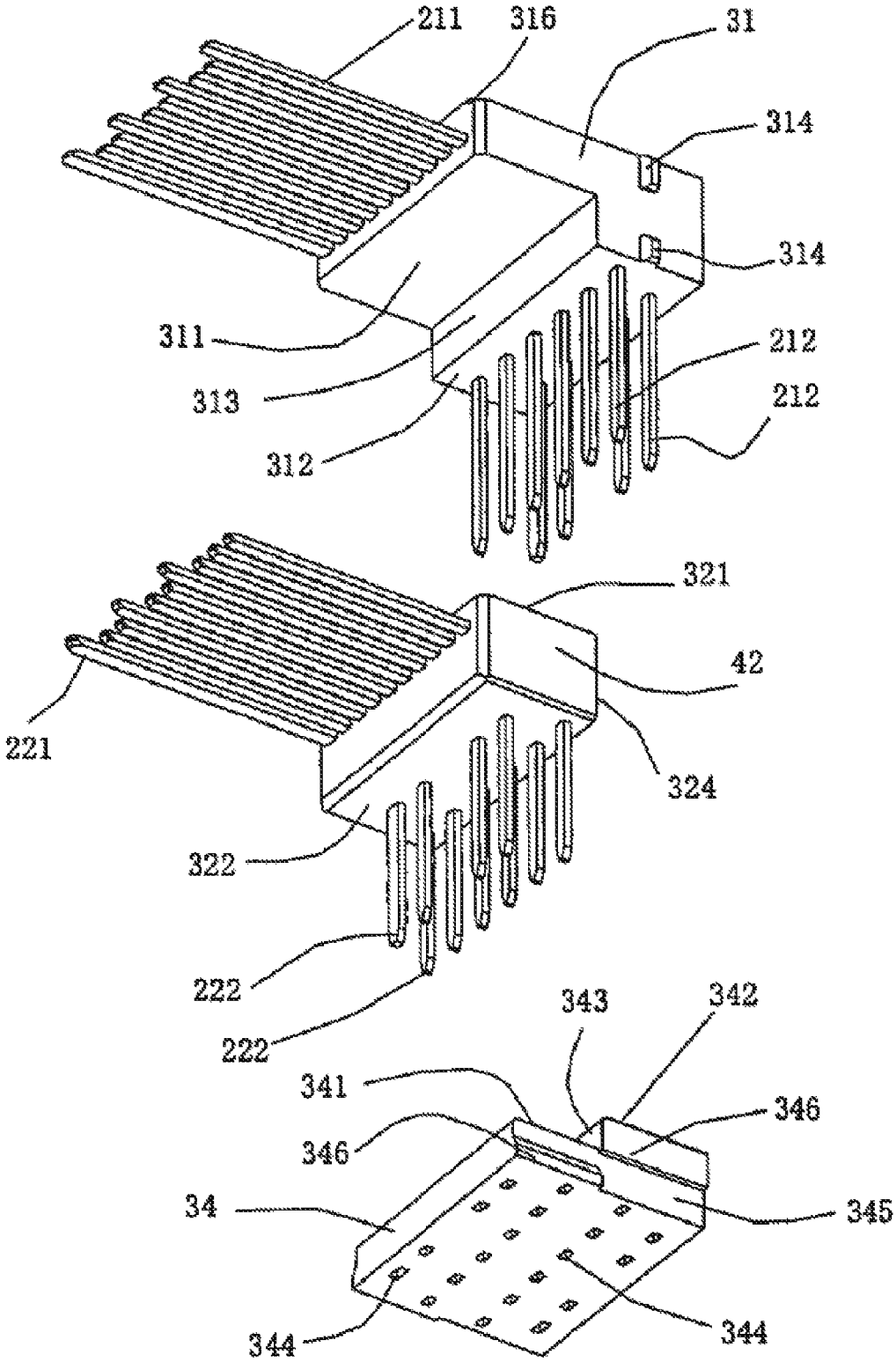
FIG. 9 is an exploded perspective view of conductive terminals, a positioning module, and a spacer plate in an electrical connector according to a preferred embodiment of the present invention shown in another angle of view.
Figure 10:
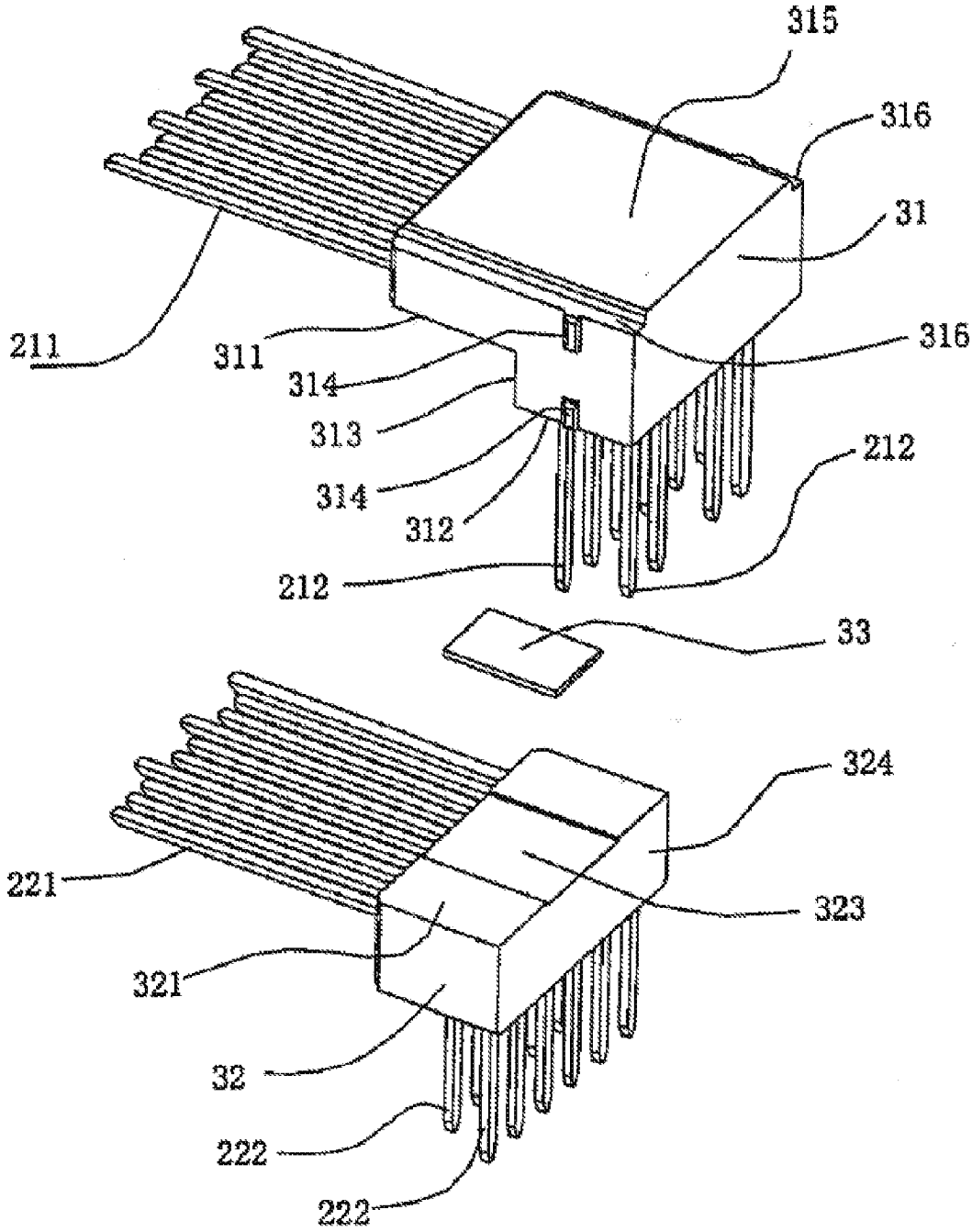
FIG. 10 is an exploded perspective view of conductive terminals and a positioning module in an electrical connector according to a preferred embodiment of the present invention.

Referring to FIGS. 8 and 9, the spacer plate 34 is provided below the first positioning module 31 and the second positioning module 32. The spacer plate 34 is formed of an insulating material by integral injection, and provided on its top with a first top surface 341, a second top surface 342 higher than the first top surface 341, and a vertical wall surface 343 connected between the first top surface 341 and the second top surface 342, forming a step body in "□" shape which is small in the front and large in the rear. The spacer plate 44 is provided with four columns of positioning holes 344, which penetrate up and down and can cover the soldering portion 212 and 222 of the upper row of conductive terminals 21 and the lower row of conductive terminals 22. Here, two rows of positioning holes 344 in the first top surface 341 cover correspondingly two columns of soldering portions 222 of the lower row of conductive terminals 22, and the first top surface 341 of the spacer plate 34 is pressed correspondingly against the bottom surface 322 of the second positioning module 32; two rows of positioning holes 344 in the second top surface 342 cover correspondingly two columns of soldering portions 212 of the upper row of conductive terminals 21, and the second top surface 342 of the spacer plate 34 is pressed correspondingly against the second bottom surface 312 of the first positioning module 31. Two side surfaces 345 of the spacer plate 34 are further protrudingly provided with two fixing portions 346 respectively, which stagger in both horizontal and vertical directions. The lower guide bar 112 on the inner surface of the sidewall 11 at the rear portion of the insulating housing 1 is slidably inserted between two fixing portions 346, so as to facilitate guiding and fitting the spacer plate 34 to the insulating housing 1.

Figure 2:
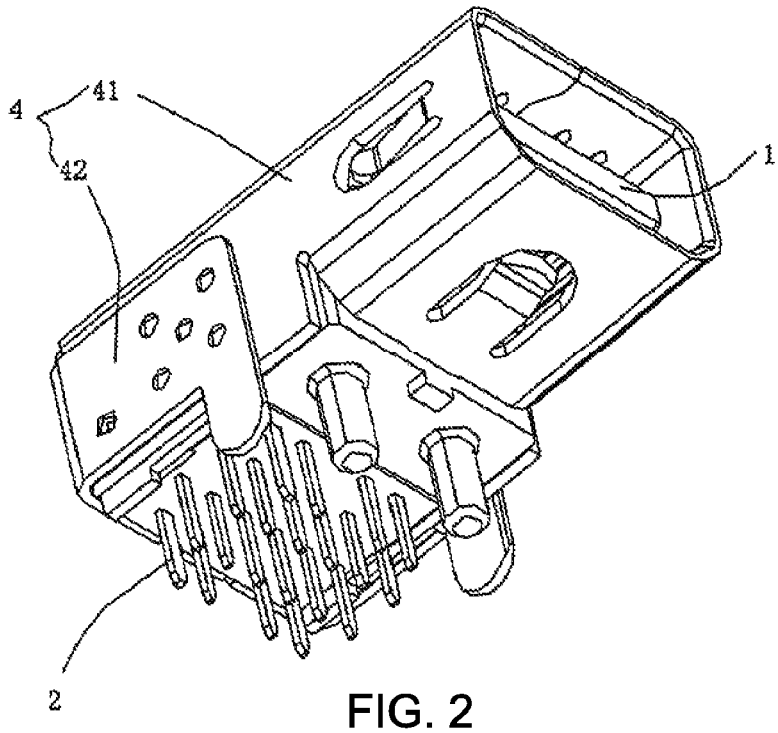
FIG. 2 is an assembled perspective view of an electrical connector according to a preferred embodiment of the present invention shown in another angle of view.
Figure 3:
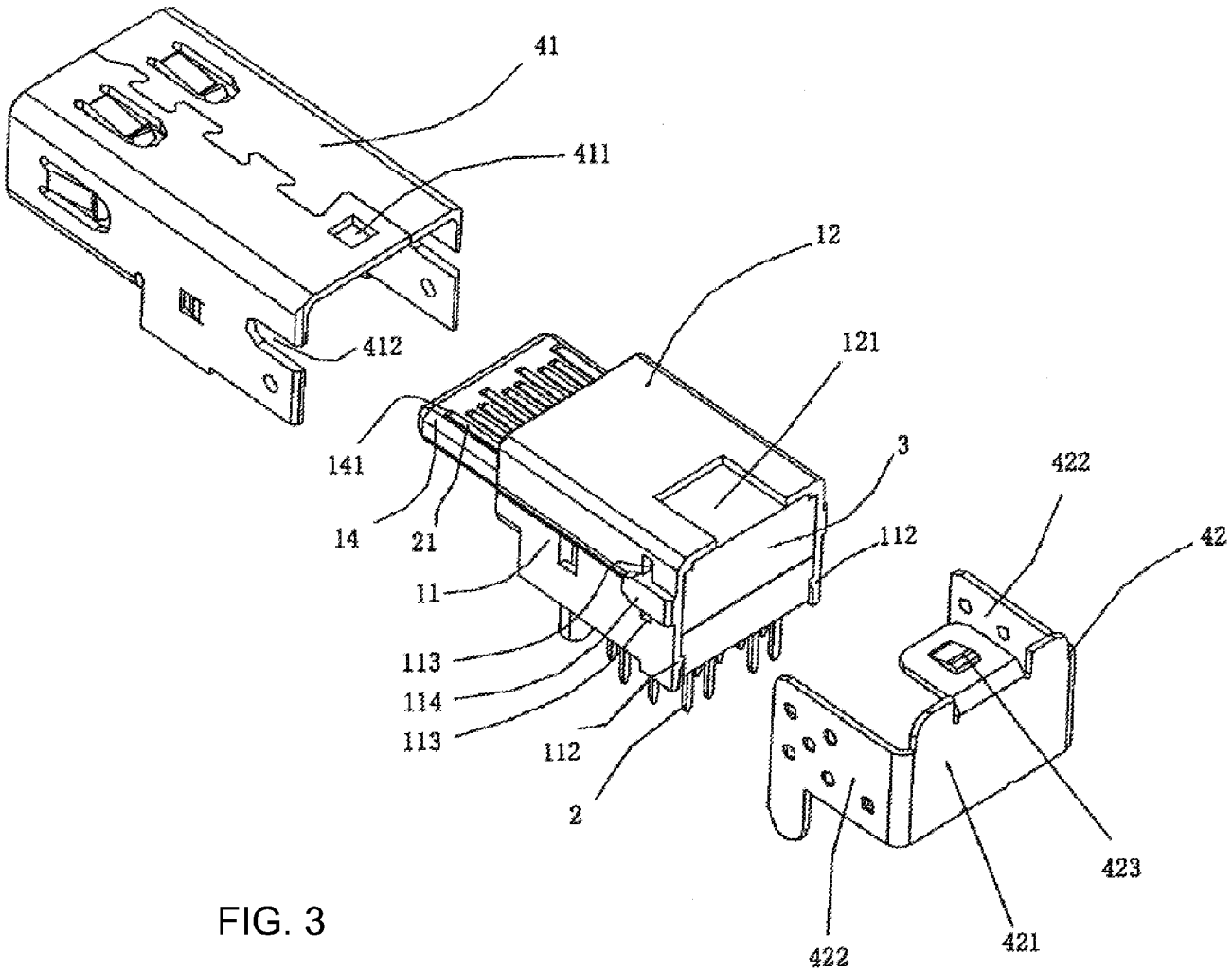
FIG. 3 is an exploded perspective view of an electrical connector according to a preferred embodiment of the present invention.
Figure 4:
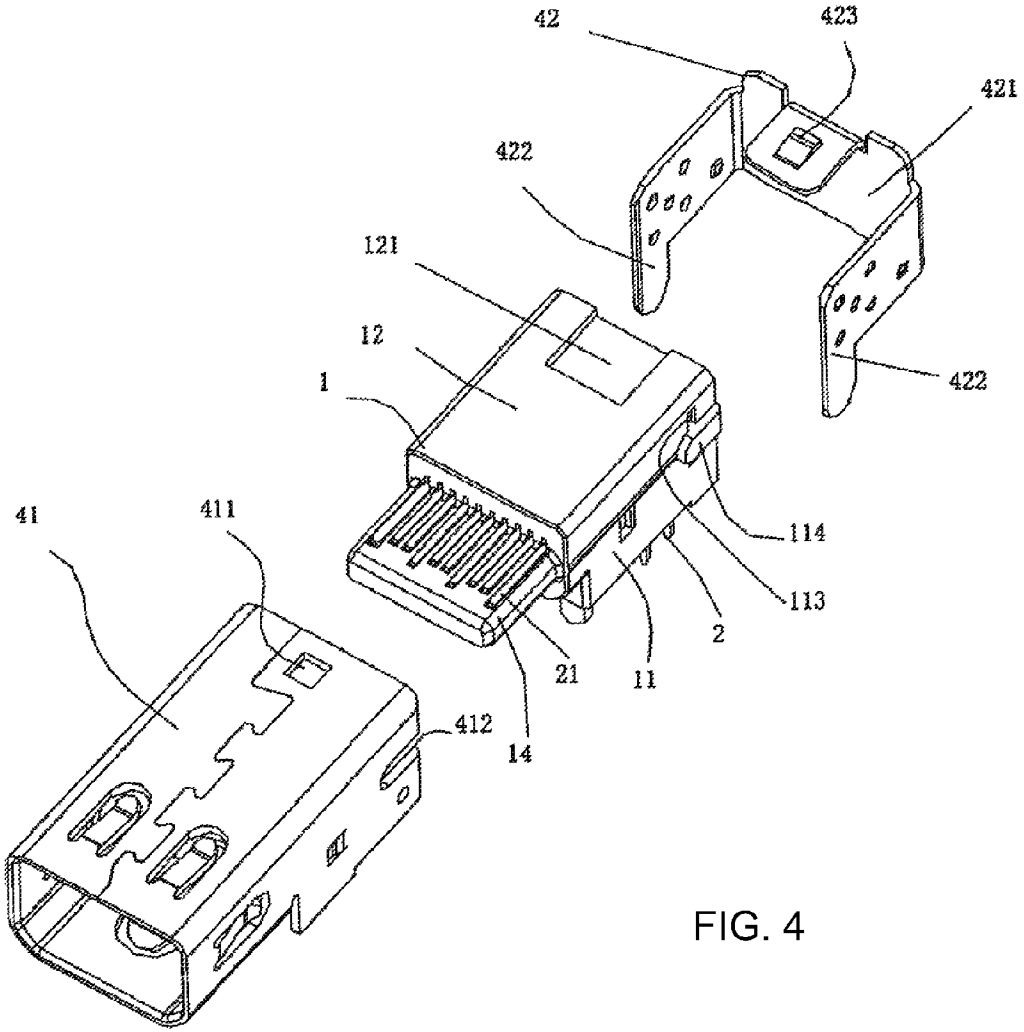
FIG. 4 is an exploded perspective view of an electrical connector according to a preferred embodiment of the present invention shown in another angle of view.

Referring to FIGS. 1 and 2, the shielding casing 4 covers the periphery of the assembly of the insulating housing 1 and the positioning module 3. Referring to FIGS. 1 to 6, the shielding casing 4 comprises a body 41 covering the periphery of the insulating housing 1, and a metal rear cover 42 enveloping the rear end of the body 41. The rear portion of the top wall of the body 41 is opened with a snap hole 411; both of the rear edges of two sidewalls of the body 41 are recessed forwards to form positioning grooves 412, so as to be fitted with the positioning bumps 114 on two sidewalls 11 of the insulating housing 1. The rear cover 42 comprises a rear cover plate 421 and two fixing plates 422 which extend forwards from two sides of the rear cover plate 421, and a fasten hook 423 extends forwards from the upper edge of the rear cover plate 421.

The manufacture and assembly procedure of the electrical connector according to the above preferred embodiment will be discussed briefly in the following.

Firstly, the first positioning module 31 is formed on the bending portions 213 of a plurality of the upper row of conductive terminals 21 by an insert-molding process. Then the second positioning module 32 is then formed on the bending portions 223 of a plurality of the lower row of conductive terminals 22 by an over-molding process; the top surface 321 of the second positioning module 32 is adhered to the first bottom surface 311 of the first positioning module 31 via the adhesive sheet 33. Next the rear end surface 324 of the second positioning module 32 is pressed against the vertical wall surface 313 of the first positioning module 31, such that the first positioning module 31 is adhesively fixed with the second positioning module 32.

Secondly, from below the first positioning module 31 and the second positioning module 32, from top to bottom, the spacer plate 34 correspondingly covers the soldering portions 212 and 222 of the upper and lower rows of conductive terminals 21 and 22 which are arranged in four columns. As can be appreciated, the first top surface 341, the vertical wall surface 343, and the second top surface 342 of the spacer plate 34 are pressed respectively against the bottom surface 322, the rear end surface 324 of the second positioning module 32, and the second bottom surface 312 of the first positioning module 31. Thus, the assembly of the positioning module 3, the spacer plate 34, and the plurality of conductive terminals 2 as shown in FIG. 7 is obtained.

Figure 7:
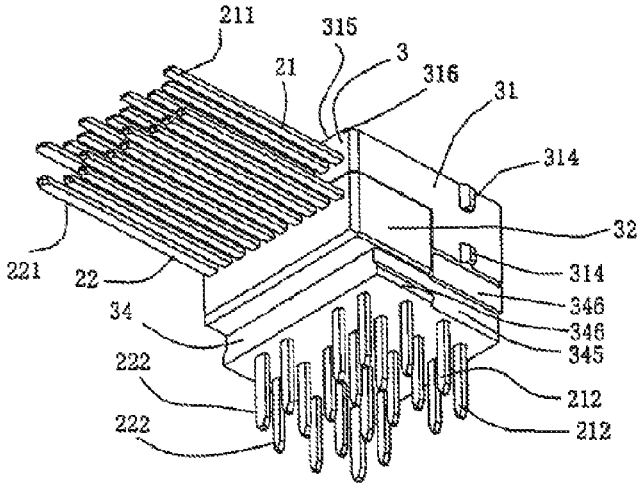
FIG. 7 is a an assembled perspective view of conductive terminals, a positioning module, and a spacer plate in an electrical connector according to a preferred embodiment of the present invention.

Thirdly, the guide grooves 316 in the top surface 315 of the first positioning module 31 are aligned with the upper guide bars 111 in the inner surface of the sidewall 11 at the rear portion of the insulating housing 1, and two fixing portions 346 in the side surface 345 of the spacer plate 34 are aligned with the lower guide bars 112 in the inner surface of the sidewall 11 at the rear portion of the insulating housing 1, from behind the insulating housing 1, the assembly shown in FIG. 7 is pushed forwards into the accommodating chamber 13 of the insulating housing 1, until the protruding portions 314 on two sides of the first positioning module 31 are fastened into the positioning holes 113 in two sidewalls 11 of the insulating housing 1, while the butting portions 211 and 221 of the upper and lower rows of conductive terminals 21 and 22 are mounted into the receiving grooves 141 in the upper and lower sides of the tongue plate 14 of the insulating housing 1 respectively, thus completing the assembling and positioning between the assembly and the insulating housing 1.

Fourthly, the body 41 of the shielding casing 4 covers the periphery of the insulating housing 1 from the front of the insulating housing 1, until the positioning grooves 412 at rear edges of two sidewalls of the body 41 are fastened to the positioning bumps 114 on two sidewalls 11 of the insulating housing 1; the rear cover 42 is fitted into the rear end of the body 41 from behind the insulating housing 1, so that the fasten hook 423 is inserted into the recess 121 in the top wall 12 of the insulating housing 1 and is in lock connection with the fasten hole 411 of the body 41, and thus the rear cover 42 can be assembled to the rear end of the body 41. Finally, two fixing plates 422 on the rear cover 42 is soldered with the rear end of the body 41 by laser, thus obtaining the electrical connector according to a preferred embodiment of the present invention.

In an embodiment, the electrical connector according to the present invention, by forming the first positioning module 31 and the second positioning module 32 at the periphery of the bending portions 213, 223 of the upper row of conductive terminals 21 and the lower row of conductive terminals 22 via an over-molding process respectively, can fix the bending portions 213, 223 of the conductive terminals 21, 22 in position. As can be appreciated, this can better prevent the thin bending portions 213, 223 of the conductive terminals 2 from contacting with each other when an external force is applied and thus helps prevent a short circuit failure. In addition; by further assembling a spacer plate 34 below the first positioning module 31 and the second positioning module 32, the soldering portions 212, 222 of the conductive terminals 21, 22 can also be substantially fixed in position, so that the object of completely preventing the conductive terminals 21, 22 from bending is achieved.

The above embodiment is provided just as preferable embodiments of the present invention, not as limitation to the implementations of the present invention. In the present invention, the purpose of dividing the positioning module design into the first positioning module 31 for enveloping the bending portions 213 of the upper row of conductive terminals 21 and the second positioning module 32 for enveloping the bending portions 223 of the lower row of conductive terminals 22 is to simplify the mold structure for over-molding the positioning modules 21, 22, so as to reduce the cost. However, in light of the main conception and spirit of the present invention, the person skilled in the art can easily modify the injection mold into an integral positioning module (not shown in the figure) enveloping both the bending portions 213, 223 of the upper row of conductive terminals 21 and the lower row of conductive terminals 22. Therefore, the protection scope of the present invention is defined in the appended claims.

What is claimed is:

1. An electrical connector, comprising:

an insulating housing, having an accommodating chamber at a rear portion thereof and a tongue plate protruding forwards from a front portion thereof, the tongue plate include an upper and lower side;

a plurality of conductive terminals, comprising an upper row of conductive terminals and a lower row of conductive terminals mounted respectively on the upper and lower sides; each conductive terminal including a butting portion, a soldering portion, and a bending portion connected between the butting portion and the soldering portion; the butting portions of the upper row of conductive terminals and lower row of conductive terminals being mounted on the upper and lower sides respectively, the soldering portions of each row of conductive terminals extending from below the rear portion of the insulating housing and being arranged in a front column and a rear column; and a first and second positioning module being configured to be mounted into the accommodating chamber of the insulating housing, the first and second positioning module each supporting a portion of the plurality of conductive terminals, the first and second position module each supporting the bending portions of the respective conductive terminals.

2. The electrical connector according to claim 1, wherein the first and second position module each supporting the bending portions of the respective conductive terminals.

3. The electrical connector according to claim 2, wherein first positioning module supports the upper row and the second positioning module supports the lower row.

4. The electrical connector according to claim 3, wherein an adhesive sheet is provided between the first positioning module and the second positioning module, wherein the adhesive sheet adheres the two positioning modules together.

5. The electrical connector according to claim 1, wherein the electrical connector further comprises a spacer plate which is provided below the first positioning module and the second positioning module, the spacer plate is provided with four columns of positioning holes which penetrate the spacer plate up and down, and the four columns of positioning holes correspondingly cover soldering portions of the upper row and lower row of conductive terminals which are arranged in four columns.

6. The electrical connector according to claim 5, wherein two side surfaces of the spacer plate are further provided with two fixing portions respectively, the fixing portions protruding from the spacer plate and staggering in both horizontal and vertical directions; a guide bar extending along the longitudinal direction of the accommodating chamber is provided on the inner surface of two sidewalls at the rear portion of the insulating housing, the guide bar can be inserted between the two fixing portions so as to assemble the spacer plate to the insulating housing.

7. The electrical connector according to claim 1, wherein the housing includes a lower bar and the accommodating chamber includes a top wall, wherein the first and second positioning module are configured to be inserted into the accommodating chamber so as to be secured in place by the lower bar and the top wall.

8. The electrical connector according to claim 1, wherein the butting portions of the conductive terminals extend straightly along horizontal direction, the soldering portions of the conductive terminals extend downwards vertically, and the bending portions thereof are connected between the butting portions and the soldering portions.

9. The electrical connector according to claim 1, wherein the upper row of conductive terminals comprise a plurality of signal terminals for signal transmission and a plurality of ground terminals, the soldering portions of the upper row of conductive terminals are arranged in a front column and a rear column, wherein soldering portions of the plurality of signal terminals are arranged in one column, while soldering portions of the plurality of ground terminals are arranged in another column.

10. The electrical connector according to claim 9, wherein the wherein the lower row of conductive terminals comprise a plurality of signal terminals for signal transmission and a plurality of ground terminals, the soldering portions of the upper row of conductive terminals are arranged in a front column and a rear column, wherein soldering portions of the plurality of signal terminals are arranged in one column, while soldering portions of the plurality of ground terminals are arranged in another column.

11. The electrical connector according to claim 10, wherein the column of signal terminals from the upper row and the column of signal terminals from the lower row are positioned adjacent each other.

12. The electrical connector according to claim 9, wherein the upper row of conductive terminals comprise ten conductive terminals, wherein four of the terminals are ground terminals and each of the adjacent ground terminals is separated from the other by two signal terminals configured to act as a differential pair and the bending portions of the signal terminals are laterally extended in a plane perpendicular to the butting direction, so that lateral spacing between soldering portions of two neighboring signal terminals which constitute the pair of differential signal is larger than that between the abutting portions thereof.

* * * * *